US011506095B1

(12) United States Patent
Lim

(10) Patent No.: US 11,506,095 B1
(45) Date of Patent: Nov. 22, 2022

(54) METHOD AND DEVICE FOR CALCULATING CONSUMPTION AMOUNT OF ENGINE OIL OF VEHICLE

(71) Applicants: Hyundai Motor Company, Seoul (KR); Kia Corporation, Seoul (KR)

(72) Inventor: Hyunkyu Lim, Suwon-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/524,602

(22) Filed: Nov. 11, 2021

(30) Foreign Application Priority Data

Sep. 15, 2021 (KR) ..... 10-2021-0123007

(51) Int. Cl.
*F01M 11/12* (2006.01)
*F01M 11/10* (2006.01)

(52) U.S. Cl.
CPC ..... *F01M 11/12* (2013.01); *F01M 2011/142* (2013.01); *F01M 2011/1426* (2013.01); *F01M 2011/1446* (2013.01); *F01M 2011/1473* (2013.01); *F01M 2011/1486* (2013.01); *F01M 2250/60* (2013.01); *F01M 2250/64* (2013.01)

(58) Field of Classification Search
CPC ..... F01M 11/12; F01M 2011/142; F01M 2011/1426; F01M 2011/1446; F01M 2011/1473; F01M 2011/1486; F01M 2250/60; F01M 2250/64
See application file for complete search history.

(56) References Cited

U.S. PATENT DOCUMENTS

2012/0044077 A1* 2/2012 Blossfeld ..... F01M 1/16 702/55
2018/0105159 A1* 4/2018 Park ..... B60K 6/442

* cited by examiner

*Primary Examiner* — Jacob M Amick
*Assistant Examiner* — Charles J Brauch
(74) *Attorney, Agent, or Firm* — Morgan, Lewis & Bockius LLP

(57) ABSTRACT

A method for determining a consumption amount of an engine oil of a vehicle includes starting, by a controller, an engine of the vehicle; and extracting and determining, by the controller, a consumption amount of the engine oil of the vehicle per unit time from a memory storing the consumption amount of the engine oil per unit time, in response to a speed of the started engine and an intake air pressure of the started engine.

10 Claims, 6 Drawing Sheets

FIG. 3

| Engine speed / Intake pressure | 650 | 800 | 1000 | 2000 | 3000 | 4000 | 5000 | 6000 |
|---|---|---|---|---|---|---|---|---|
| 0 | 2 | 3 | 5 | 10 | 15 | 25 | 35 | 40 |
| 500 | | 2 | 3 | 5 | 10 | 20 | 25 | 30 |
| 550 | | 2 | 3 | 5 | 10 | 10 | 15 | 20 |
| 600 | | 2 | 3 | 5 | 10 | 10 | 15 | 20 |
| 650 | | 2 | 5 | 5 | 10 | 15 | 15 | 20 |
| 700 | | 5 | 5 | 7 | 10 | 15 | 15 | 20 |
| 750 | | 5 | 5 | 7 | 10 | 15 | 15 | 20 |
| 800 | | 7 | 7 | 7 | 10 | 15 | 20 | 25 |
| 850 | | 7 | 7 | 7 | 10 | 15 | 20 | 25 |
| 900 | | 10 | 10 | 10 | 15 | 20 | 25 | 30 |
| 1000 | | 10 | 10 | 10 | 15 | 20 | 25 | 30 |

FIG. 4

| Intake Pressure [hPa] | 400 | 350 | 300 | 250 | 200 | 150 |
|---|---|---|---|---|---|---|
| CORRECTION VALUE | 0.4 | 0.6 | 0.8 | 1 | 1.2 | 1.4 |

FIG. 5

| COASTING DRIVE MAINTENANCE TIME [sec] | 1 | 5 | 10 | 15 | 20 | 30 |
|---|---|---|---|---|---|---|
| CORRECTION VALUE | 1 | 2 | 3 | 4 | 5 | 6 |

FIG. 6

| Mileage [km] | 0 | 10,000 | 50,000 | 100,000 | 150,000 | 200,000 |
|---|---|---|---|---|---|---|
| CORRECTION VALUE | 0 | 0.9 | 1 | 1.2 | 1.4 | 1.6 |

METHOD AND DEVICE FOR CALCULATING CONSUMPTION AMOUNT OF ENGINE OIL OF VEHICLE

CROSS-REFERENCE TO RELATED APPLICATION

The present application claims priority to Korean Patent Application No. 10-2021-0123007 filed on Sep. 15, 2021, the entire contents of which is incorporated herein for all purposes by this reference.

BACKGROUND OF THE INVENTION

Field of the Invention

The present invention relates to a vehicle, and more particularly, to a method and device for determining a consumption amount of engine oil of the vehicle.

Description of Related Art

A lubrication device is a device that facilitates an operation of an engine and supplies engine oil to a motion frictional part of the engine in order to maintain the operation for a long time until the lifespan of the engine ends.

An engine has a sliding part like a cylinder and a piston or a rotating part like a crankshaft and a camshaft. When metals of such motion frictional parts come into contact with each other, frictional heat is generated and a frictional surface becomes rough. Thus, failures such as quick abrasion or melting of a contact surface due to the generated frictional heat occur such that the engine may not operate.

Therefore, to prevent such a phenomenon, when engine oil is supplied to sliding (slip) surfaces of metal, since an oil film is formed between the sliding surfaces, solid friction is changed to fluid friction, and thus frictional resistance decreases, decreasing abrasion, and preventing a temperature rise due to the frictional heat.

Accordingly, when the engine is operating, the engine oil acts on each frictional part to perform a lubrication operation, but when the engine operates for a long time, the engine oil rises to a combustion chamber due to abrasion of the lubricating device, and the engine oil is consumed. Thus, since the engine oil may be consumed excessively, it is necessary to reduce oil consumption from an economical point of view. Furthermore, when a large amount of oil is combusted in the combustion chamber, since harmful components in exhaust gas increase, it is necessary to measure the precise consumption amount of the engine oil not only during the engine development stage but also during the operation of the vehicle.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a method and device configured for determining a consumption amount of engine oil of a vehicle having advantages of determining the consumption amount of the engine oil of the vehicle based on a consumption amount of the engine oil stored in a memory.

Various aspects of the present invention are directed to providing a method for determining a consumption amount of an engine oil of a vehicle including starting, by a controller, an engine of the vehicle; and extracting and determining, by the controller, a consumption amount of the engine oil of the vehicle per unit time from a memory storing the consumption amount of the engine oil per unit time, in response to a speed of the started engine and an intake air pressure of the started engine.

The method may further include correcting, by the controller, the determined consumption amount of the engine oil of the vehicle, based on a correction value according to the intake air pressure of the engine upon coasting drive of the vehicle stored in the memory.

The method may further include correcting, by the controller, the determined consumption amount of the engine oil of the vehicle, based on the correction value according to the intake air pressure of the engine upon coasting drive of the vehicle and a correction value according to a coasting drive maintenance time of the vehicle, and the correction value according to the intake air pressure of the engine upon coasting drive of the vehicle and the correction value according to a coasting drive maintenance time of the vehicle may be stored in the memory The method may further include correcting, by the controller, the determined consumption amount of the engine oil of the vehicle, based on the correction value according to the intake air pressure of the engine upon coasting drive of the vehicle, a correction value according to a coasting drive maintenance time of the vehicle, and a correction value according to a travel distance of the vehicle, and the correction value according to the intake air pressure of the engine upon coasting drive of the vehicle, the correction value according to a coasting drive maintenance time of the vehicle, and the correction value according to a travel distance of the vehicle may be stored in the memory.

The method may further include determining, by the controller, an accumulated consumption amount of the engine oil, based on the determined consumption amount of the engine oil of the vehicle and a time period from a time in which the engine is started to a time in which the consumption amount of the engine oil is determined; and determining, by the controller, whether the accumulated consumption amount of the engine oil exceeds a reference value, and when the controller concludes that the accumulated consumption amount of the engine oil exceeds the reference value, the controller may be configured to control a display apparatus electrically connected to the controller to display a message instructing a user of the vehicle to supplement the engine oil.

The method may further include determining, by the controller, an accumulated consumption amount of the engine oil, based on the corrected consumption amount of the engine oil of the vehicle and a time period from a time in which the engine is started to a time in which the corrected consumption amount of the engine oil is determined; and determining, by the controller, whether the accumulated consumption amount of the engine oil exceeds a reference value, and when the controller concludes that the accumulated consumption amount of the engine oil exceeds the reference value, the controller may be configured to control a display apparatus electrically connected to the controller to display a message instructing a user of the vehicle to supplement the engine oil.

Various aspects of the present invention are directed to providing a device configured for determining a consumption amount of an engine oil of a vehicle including a memory storing a consumption amount of the engine oil per unit time; and a controller configured to start an engine of the vehicle, wherein the controller may extract and determine the consumption amount of the engine oil of the vehicle per unit time from the memory in response to a speed of the started engine and an intake air pressure of the started engine.

The controller may correct the determined consumption amount of the engine oil of the vehicle, based on a correction value according to the intake air pressure of the engine upon coasting drive of the vehicle stored in the memory.

The controller may correct the determined consumption amount of the engine oil of the vehicle, based on the correction value according to the intake air pressure of the engine upon coasting drive of the vehicle and a correction value according to a coasting drive maintenance time of the vehicle, and the correction value according to the intake air pressure of the engine upon coasting drive of the vehicle and the correction value according to a coasting drive maintenance time of the vehicle may be stored in the memory.

The controller may correct the determined consumption amount of the engine oil of the vehicle, based on the correction value according to the intake air pressure of the engine upon coasting drive of the vehicle, a correction value according to a coasting drive maintenance time of the vehicle, and a correction value according to a travel distance of the vehicle, and the correction value according to the intake air pressure of the engine upon coasting drive of the vehicle, the correction value according to a coasting drive maintenance time of the vehicle, and the correction value according to a travel distance of the vehicle may be stored in the memory.

The controller may be configured to determine an accumulated consumption amount of the engine oil, based on the determined consumption amount of the engine oil of the vehicle and a time period from a time in which the engine is started to a time in which the consumption amount of the engine oil is determined, the controller may be configured to determine whether the accumulated consumption amount of the engine oil exceeds a reference value, and when the controller concludes that the accumulated consumption amount of the engine oil exceeds the reference value, the controller may be configured to control a display apparatus electrically connected to the controller to display a message instructing a user of the vehicle to supplement the engine oil.

The controller may be configured to determine an accumulated consumption amount of the engine oil, based on the corrected consumption amount of the engine oil of the vehicle and a time period from a time in which the engine is started to a time in which the corrected consumption amount of the engine oil is determined, the controller may be configured to determine whether the accumulated consumption amount of the engine oil exceeds a reference value, and when the controller concludes that the accumulated consumption amount of the engine oil exceeds the reference value, the controller may be configured to control a display apparatus electrically connected to the controller to display a message instructing a user of the vehicle to supplement the engine oil.

The method and device configured for determining a consumption amount of engine oil of a vehicle according to various exemplary embodiments of the present invention described above may determine the consumption amount of the engine oil of the vehicle based on a consumption amount of the engine oil stored in a memory.

Furthermore, an exemplary embodiment of the present invention may display a notification message when the engine oil is insufficient and provide the notification message to a user of the vehicle.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

FIG. 3 is a table showing a consumption amount of an engine oil stored in a memory used in a determination step illustrated in FIG. 1.

FIG. 4 is a drawing illustrating a correction value (or a correction factor or a calibration factor) according to an intake gas pressure of an engine upon coating drive of the vehicle for correcting the consumption amount of the engine oil illustrated in FIG. 3.

FIG. 5 is a drawing illustrating a correction value according to a coasting drive maintenance time of a vehicle for correcting the consumption amount of the engine oil illustrated in FIG. 3.

FIG. 6 is a drawing illustrating a correction value according to a travel distance (mileage) of a vehicle for correcting the consumption amount of the engine oil illustrated in FIG. 3.

Figure 1:
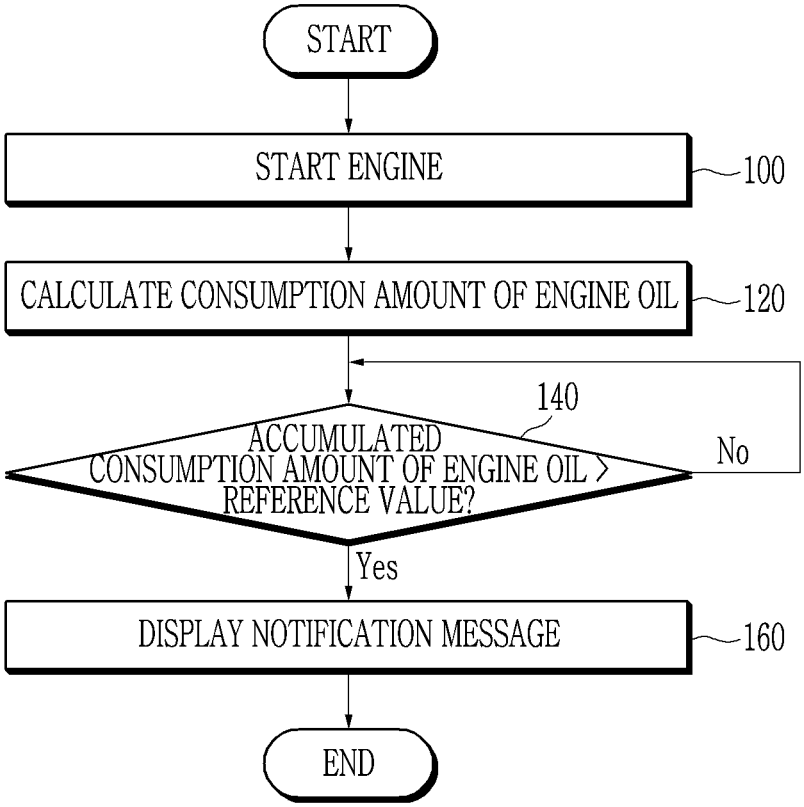
FIG. 1 is a flowchart illustrating a method for determining a consumption amount of an engine oil of a vehicle according to various exemplary embodiments of the present invention.

It may be understood that the appended drawings are not necessarily to scale, presenting a somewhat simplified representation of various features illustrative of the basic principles of the invention. The specific design features of the present invention as included herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments of the present invention, it will be understood that the present description is not intended to limit the invention(s) to those exemplary embodiments. On the contrary, the invention(s) is/are intended to cover not only the exemplary embodiments of the present invention, but also various alternatives, modifications, equivalents and other embodiments, which may be included within the spirit and scope of the invention as defined by the appended claims.

To fully understand the present invention and the objects achieved by the embodying of the present invention, reference should be made to the accompanying drawings illustrating various exemplary embodiments of the present invention and the description indicated in the accompanying drawings.

Hereinafter, the present invention will be described in detail by describing various exemplary embodiments of the present invention with reference to the accompanying drawings. In describing the present invention, when it is determined that a detailed description of a related known configuration or function may obscure the gist of the present invention, the detailed description will be omitted. The same reference numerals presented in each drawing may indicate the same constituent element.

The term used in the specification is used only to describe a specific exemplary embodiment of the present invention, and is not intended to limit the present invention. Expressions in the singular include a plurality of expressions unless the context clearly dictates otherwise. In the specification, the terms such as "comprise" or "have" are intended to designate the presence of a feature, number, step, operation, constituent element, part, or combinations thereof described in the specification, and it should be understood that the terms do not preclude in advance the possibility of the presence or addition of one or more other features or numbers, steps, operations, constituent elements, parts or combinations thereof.

Throughout this specification and the claims that follow, when it is described that an element is "coupled" to another element, not only it is "directly coupled" to the other element, but also it is "electrically or mechanically coupled" to the other element with another constituent element therebetween.

Unless defined otherwise, terms used herein, including technical or scientific terms, have the same meaning as commonly understood by a person of an ordinary skill in the art to which various exemplary embodiments of the present invention belong. Terms such as those defined in the generally-used dictionary should be interpreted as having a meaning consistent with the meaning in the context of the related technology, and unless explicitly defined in the specification, are not interpreted in an ideal or excessively formal meaning.

Figure 2:
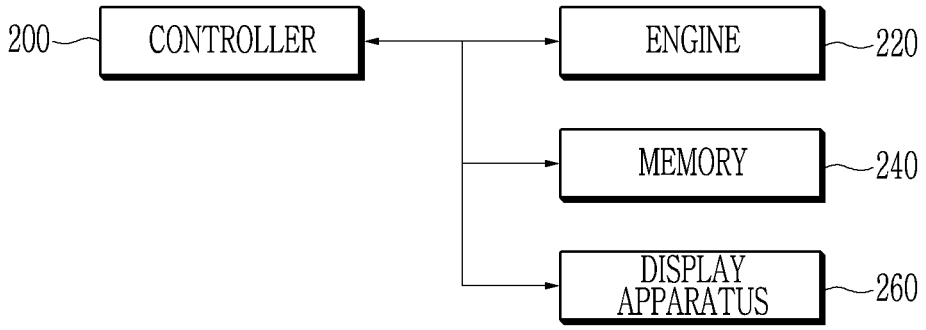
FIG. 2 is a block diagram illustrating a device configured for determining a consumption amount of an engine oil of a vehicle to which the method for determining the consumption amount of the engine oil of the vehicle illustrated in FIG. 1 is applied.

FIG. 1 is a flowchart illustrating a method for determining a consumption amount of an engine oil of a vehicle according to various exemplary embodiments of the present invention. FIG. 2 is a block diagram illustrating a device configured for determining a consumption amount of an engine oil of a vehicle to which the method for determining the consumption amount of the engine oil of the vehicle illustrated in FIG. 1 is applied. FIG. 3 is a table showing a consumption amount of an engine oil stored in a memory used in a determination step illustrated in FIG. 1. FIG. 4 is a drawing illustrating a correction value (or a correction factor or a calibration factor) according to an intake gas pressure of an engine upon coating drive of the vehicle for correcting the consumption amount of the engine oil illustrated in FIG. 3. FIG. 5 is a drawing illustrating a correction value according to a coasting drive maintenance time of the vehicle for correcting the consumption amount of the engine oil illustrated in FIG. 3. FIG. 6 is a drawing illustrating a correction value according to a travel distance (mileage) of the vehicle for correcting the consumption amount of the engine oil illustrated in FIG. 3.

Referring to FIGS. 1 to 6, in a starting step 100, a controller 200 may start an engine 220 such as a gasoline engine of the vehicle. For example, the controller 200 may start the engine 220 in response to a request signal from a user (e.g., a driver) of the vehicle.

The controller 200 is an electronic control unit (ECU) and may control the entire operation of the vehicle including a device configured for determining a consumption amount of an engine oil of the vehicle. The controller 200 may be, for example, at least one microprocessor operating by a program (control logic) or hardware (e.g., a microcomputer) including the microprocessor. The program may include a series of instructions for performing the method for determining the consumption amount of the engine oil of the vehicle according to various exemplary embodiments of the present invention. The instructions may be stored in a memory 240 of the device configured for determining the consumption amount of the engine oil of the vehicle.

The device configured for determining the consumption amount of the engine oil of the vehicle may include the controller 200, the memory 240, and a display apparatus 260.

According to step 120, the controller 200 may determine (or extract) a consumption amount of the engine oil of the vehicle including the started engine 220 per unit time from the consumption amount of the engine oil per unit time stored in the memory 240 in response to the speed of the started engine 220 and the intake gas pressure of the started engine 220. The engine oil inside a liner of a combustion chamber of the engine 220 may be burned out or the engine oil may escape to an exhaust valve of the engine 220 so that an amount of the engine oil in an oil pan of the vehicle may be reduced. The engine oil may perform a lubricating function and a cooling function in the engine 220 to improve the performance of the engine 220 and extend the lifespan of the engine 220. For example, the rotation speed of the engine 220 may be detected by an engine speed sensor of the vehicle and provided to the controller 200, and the intake air pressure of the engine 220 may be detected by an intake gas pressure sensor of the vehicle and provided to the controller 200.

As illustrated in FIG. 3, the consumption amount of the engine oil per unit time may be a value according to the rotation speed of the engine 220 (or the number of revolutions per minute of the engine 220) and the intake gas pressure of the engine 220 (or the load of the engine 220). For example, the consumption amount of the engine oil per unit time may be stored in the memory 240 in a form of a table (or a map table), and may be determined by a test (or an experiment).

The unit of the consumption amount of the engine oil illustrated in FIG. 3 may be g/sec, the unit of the rotation speed of the engine 220 illustrated in FIG. 3 may be rpm, and the unit of the intake air pressure of the engine illustrated in FIG. 3 may be hPa.

In another exemplary embodiment of the present invention, the controller 200 may correct the consumption amount of the engine oil of the vehicle determined in step 120 using the correction value according to the intake air pressure of the engine 220 upon coasting drive of the vehicle as illustrated in FIG. 4. When the intake air pressure of the engine 220 is reduced, the correction value may be increased.

For example, the controller 200 may correct the consumption amount of the engine oil of the vehicle determined in step 120 by multiplying the consumption amount of the engine oil of the vehicle determined in step 120 by the correction value according to the intake air pressure of the engine 220. For example, the correction value according to the intake air pressure of the engine 220 upon coasting drive of the vehicle may be stored in the memory 240 in a form of the table (or the map table), and determined by the test (or the experiment).

In another exemplary embodiment of the present invention, the controller 200 may correct the consumption amount of the engine oil of the vehicle determined in step 120 using the correction value according to the coasting drive maintenance time of the vehicle illustrated in FIG. 5. The correction value may be increased when the coasting drive maintenance time of the vehicle is increased.

For example, the controller 200 may correct the consumption amount of the engine oil of the vehicle determined in step 120 by multiplying the consumption amount of the engine oil of the vehicle determined in step 120 by the correction value according to the coasting drive maintenance time of the vehicle. For example, the correction value according to the coasting drive maintenance time of the vehicle may be stored in the memory 240 in a form of the table (or the map table), and may be determined by the test (or the experiment).

In another exemplary embodiment of the present invention, the controller 200 may correct the consumption amount of the engine oil of the vehicle determined in step 120 using the correction value according to the travel distance (mileage) of the vehicle illustrated in FIG. 6. The correction value may be increased when the travel distance of the vehicle is increased.

For example, the controller 200 may correct the consumption amount of the engine oil of the vehicle determined in step 120 by multiplying the consumption amount of the engine oil of the vehicle determined in step 120 by the correction value according to the travel distance (mileage) of the vehicle. For example, the correction value according to the travel distance (mileage) of the vehicle may be stored in the memory 240 in a form of the table (or the map table), and may be determined by the test (or the experiment).

In another exemplary embodiment of the present invention, the controller 200 may correct the consumption amount of the engine oil of the vehicle determined in step 120 using the correction value according to the intake air pressure of the engine 220 upon coasting drive of the vehicle as illustrated in FIG. 4 and the correction value according to the coasting drive maintenance time of the vehicle illustrated in FIG. 5.

For example, the controller 200 may correct the consumption amount of the engine oil of the vehicle determined in step 120 by multiplying the consumption amount of the engine oil of the vehicle determined in step 120 by the correction value according to the intake air pressure of the engine 220 and the correction value according to the coasting drive maintenance time of the vehicle.

In another exemplary embodiment of the present invention, the controller 200 may correct the consumption amount of the engine oil of the vehicle determined in step 120 using the correction value according to the intake air pressure of the engine 220 upon coasting drive of the vehicle as illustrated in FIG. 4, the correction value according to the coasting drive maintenance time of the vehicle illustrated in FIG. 5, and the correction value according to the travel distance (mileage) of the vehicle illustrated in FIG. 6.

For example, the controller 200 may correct the consumption amount of the engine oil of the vehicle determined in step 120 by multiplying the consumption amount of the engine oil of the vehicle determined in step 120 by the correction value according to the intake air pressure of the engine 220, the correction value according to the coasting drive maintenance time of the vehicle, and the correction value according to the travel distance (mileage) of the vehicle.

The controller 200 may determine an accumulated consumption amount of the engine oil based on the consumption amount of the engine oil of the vehicle determined in step 120 (or the corrected consumption amount of the engine oil) and a time period from when the engine 220 is started to when the consumption amount of the engine oil is determined (or a time period (a required time period) from when the engine 220 is started to when the corrected consumption amount of the engine oil is determined). For example, the controller 200 may determine the accumulated consumption amount of the engine oil by determining the consumption amount of the engine oil of the vehicle determined in step 120 (or the corrected consumption amount of the engine oil) as a consumption amount of the engine oil every unit time (e.g., 1 second) and accumulating the determined consumption amount of the engine oil every unit time until the time period from when the engine 220 is started to when the consumption amount of the engine oil is determined (or the time period (the required time period) from when the engine 220 is started to when the corrected consumption amount of the engine oil is determined).

According to step 140, the controller 200 may determine whether the accumulated consumption amount of the engine oil exceeds a reference value (e.g., 850 (g)). The reference value is a value for preventing damage to the engine 220 due to insufficient engine oil, and may be determined by a test (or an experiment).

When the accumulated consumption amount of the engine oil exceeds the reference value, the method for determining the consumption amount of the engine oil of the vehicle which is a process may proceed to step 160.

According to step 160, the controller 200 may control the display apparatus (e.g., a cluster) 260 to display a message instructing the user (e.g., a driver) of the vehicle to supplement the engine oil.

A constituent element or "~ unit" or "~ or" or a block or a module used in various exemplary embodiments of the present invention may be implemented as software such as a task, a class, a subroutine, a process, an object, a thread of execution, and a program executed in a certain area on a memory or hardware such as a field-programmable gate array (FPGA) or an application-specific integrated circuit (ASIC), and may be in a combination of the software and the hardware. The constituent element or '~ unit' may be included in a computer-readable storage medium, or a part thereof may be dispersed and distributed in a plurality of computers.

Furthermore, the term related to a control device such as "controller", "control unit", "control device" or "control module", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present invention. The control device according to exemplary embodiments of the present invention may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors. The processor may include various logic circuits and operation circuits, may process data according to a program provided from the memory, and may generate a control signal according to the processing result.

The control device may be at least one microprocessor operated by a predetermined program which may include a series of commands for carrying out the method included in the aforementioned various exemplary embodiments of the present invention.

The aforementioned invention can also be embodied as computer readable codes on a computer readable recording medium. The computer readable recording medium is any data storage device that can store data which can be thereafter read by a computer system. Examples of the computer readable recording medium include hard disk drive (HDD), solid state disk (SSD), silicon disk drive (SDD), read-only memory (ROM), random-access memory (RAM), CD-ROMs, magnetic tapes, floppy discs, optical data storage devices, etc and implementation as carrier waves (e.g., transmission over the Internet).

In various exemplary embodiments of the present invention, each operation described above may be performed by a control device, and the control device may be configured by a plurality of control devices, or an integrated single control device.

In various exemplary embodiments of the present invention, the control device may be implemented in a form of hardware or software, or may be implemented in a combination of hardware and software.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A method for determining a consumption amount of an engine oil of a vehicle, the method comprising:

starting, by a controller, an engine of the vehicle;

extracting and determining, by the controller, the consumption amount of the engine oil of the vehicle per unit time from a non-transitory computer readable storage storing the consumption amount of the engine oil per unit time, in response to a speed of the started engine and an intake air pressure of the started engine; and correcting, by the controller, the determined consumption amount of the engine oil of the vehicle, based on a correction value according to the intake air pressure of the engine upon coasting drive of the vehicle, the correction value stored in the non-transitory computer readable storage.

2. The method of claim 1, further including:

correcting, by the controller, the determined consumption amount of the engine oil of the vehicle, based on the correction value according to the intake air pressure of the engine upon coasting drive of the vehicle and a correction value according to a coasting drive maintenance time of the vehicle, wherein the correction value according to the coasting drive maintenance time of the vehicle is stored in the non-transitory computer readable storage.

3. The method of claim 1, further including:

correcting, by the controller, the determined consumption amount of the engine oil of the vehicle, based on the correction value according to the intake air pressure of the engine upon the coasting drive of the vehicle, a correction value according to a coasting drive maintenance time of the vehicle, and a correction value according to a travel distance of the vehicle, wherein the correction value according to the coasting drive maintenance time of the vehicle and the correction value according to the travel distance of the vehicle are stored in the non-transitory computer readable storage.

4. The method of claim 1, further including:

determining, by the controller, an accumulated consumption amount of the engine oil, based on the determined consumption amount of the engine oil of the vehicle and a time period from a time in which the engine is started to a time in which the consumption amount of the engine oil is determined; and determining, by the controller, whether the accumulated consumption amount of the engine oil exceeds a reference value, wherein when the controller concludes that the accumulated consumption amount of the engine oil exceeds the reference value, the controller is further configured to control a display apparatus electrically connected to the controller to display a message instructing a user of the vehicle to supplement the engine oil.

5. The method of claim 3, further including:

determining, by the controller, an accumulated consumption amount of the engine oil, based on the corrected consumption amount of the engine oil of the vehicle and a time period from a time in which the engine is started to a time in which the corrected consumption amount of the engine oil is determined; and determining, by the controller, whether the accumulated consumption amount of the engine oil exceeds a reference value, wherein when the controller concludes that the accumulated consumption amount of the engine oil exceeds the reference value, the controller is further configured to control a display apparatus electrically connected to the controller to display a message instructing a user of the vehicle to supplement the engine oil.

6. An apparatus for determining a consumption amount of an engine oil of a vehicle, the apparatus comprising:

a non-transitory computer readable storage storing the consumption amount of the engine oil per unit time; and a controller electrically connected to the non-transitory computer readable storage and configured to start an engine of the vehicle, wherein the controller is further configured to extract and determine the consumption amount of the engine oil of the vehicle per unit time from the non-transitory computer readable storage in response to a speed of the started engine and an intake air pressure of the started engine, and wherein the controller is further configured to correct the determined consumption amount of the engine oil of the vehicle, based on a correction value according to the intake air pressure of the engine upon coasting drive of the vehicle, the correction value stored in the non-transitory computer readable storage.

7. The apparatus of claim 6, wherein the controller is further configured to correct the determined consumption amount of the engine oil of the vehicle, based on the correction value according to the intake air pressure of the engine upon coasting drive of the vehicle and a correction value according to a coasting drive maintenance time of the vehicle, and wherein the correction value according to the coasting drive maintenance time of the vehicle is stored in the non-transitory computer readable storage.

8. The apparatus of claim 6, wherein the controller is further configured to correct the determined consumption amount of the engine oil of the vehicle, based on the correction value according to the intake air pressure of the engine upon the coasting drive of the vehicle, a correction value according to a coasting drive maintenance time of the vehicle, and a correction value according to a travel distance of the vehicle, and wherein the correction value according to the coasting drive maintenance time of the vehicle and the correction value according to the travel distance of the vehicle are stored in the non-transitory computer readable storage.

9. The apparatus of claim 6, wherein the controller is further configured to determine an accumulated consumption amount of the engine oil, based on the determined consumption amount of the engine oil of the vehicle and a time period from a time in which the engine is started to a time in which the consumption amount of the engine oil is determined, wherein the controller is further configured to determine whether the accumulated consumption amount of the engine oil exceeds a reference value, and wherein when the controller concludes that the accumulated consumption amount of the engine oil exceeds the reference value, the controller is further configured to control a display apparatus electrically connected to the controller to display a message instructing a user of the vehicle to supplement the engine oil.

10. The apparatus of claim 8, wherein the controller is further configured to determine an accumulated consumption amount of the engine oil, based on the corrected consumption amount of the engine oil of the vehicle and a time period from a time in which the engine is started to a time in which the corrected consumption amount of the engine oil is determined, wherein the controller is further configured to determine whether the accumulated consumption amount of the engine oil exceeds a reference value, and wherein when the controller concludes that the accumulated consumption amount of the engine oil exceeds the reference value, the controller is further configured to control a display apparatus electrically connected to the controller to display a message instructing a user of the vehicle to supplement the engine oil.

* * * * *